US005188128A

United States Patent [19]

Studt

[11] Patent Number: 5,188,128

[45] Date of Patent: Feb. 23, 1993

[54] APPARATUS FOR CLASSIFYING PARTICLES OF TOBACCO AND THE LIKE

[75] Inventor: Stephan Studt, Hamburg, Fed. Rep. of Germany

[73] Assignee: Körber AG, Hamburg, Fed. Rep. of Germany

[21] Appl. No.: 749,154

[22] Filed: Aug. 23, 1991

[30] Foreign Application Priority Data

Sep. 1, 1990 [DE] Fed. Rep. of Germany ..... 4027748

[51] Int. Cl.[5] ..... A24B 3/16

[52] U.S. Cl. ..... 131/110; 131/312; 209/674

[58] Field of Search ..... 131/110, 312; 209/674

[56] References Cited

U.S. PATENT DOCUMENTS

| | | | |
|---|---|---|---|
| 4,195,644 | 1/1980 | Heitmann | 131/109 |
| 4,569,446 | 2/1986 | Kelley | 209/674 |
| 4,991,598 | 2/1991 | Henderson et al. | 131/312 |
| 5,063,944 | 11/1991 | Parker | 131/110 |

FOREIGN PATENT DOCUMENTS 9000291 4/1990 Fed. Rep. of Germany .

*Primary Examiner*—V. Millin
*Assistant Examiner*—J. Doyle
*Attorney, Agent, or Firm*—Peter K. Kontler

[57] ABSTRACT

Apparatus for separating longer tobacco particles from shorter tobacco particles has an elongated vibratory trough for the advancement of a stream containing a mixture of shorter and longer particles from a delivering conveyor to a collecting receptacle. The upper side of the bottom wall of the trough is formed with longitudinally extending depressions which receive and align the particles of the advancing stream, and the bottom wall is formed with one or more transversely extending slots which extend across the depressions and permit shorter particles to descend into a second trough from which the shorter particles return into the distributor of a cigarette rod making machine. The properly aligned longer particles advance across the slot or slots and enter the receptacle. The slot or slots make oblique angles with the direction of advancement of particles along the bottom wall of the vibratory trough to ensure that any particles which happen to be caught in a slot are moved sideways and out of the way into a third trough so that the next-following shorter particles can enter the respective slot or slots. The stream consists mainly of longer particles and is obtained as a result of classification of a mixture of shorter and longer particles in the distributor.

18 Claims, 2 Drawing Sheets

APPARATUS FOR CLASSIFYING PARTICLES OF TOBACCO AND THE LIKE

BACKGROUND OF THE INVENTION

The invention relates to apparatus for classifying streams or batches which contain mixtures of randomly distributed larger (particularly longer and harder) and smaller (particularly shorter and softer) particles. Typical examples of streams or batches (hereinafter referred to as streams) which can be treated in the apparatus of the present invention are those containing fragments of tobacco stem and/or ribs in random distribution with shreds of tobacco leaf laminae.

The so-called distributor (also known as hopper) of a cigarette rod making machine comprises a magazine for reception of a relatively large supply of tobacco particles. Such particles are a mixture of longer and heavier particles (particularly fragments of tobacco stem and/or ribs) and shorter and softer particles, such as shreaded tobacco leaf laminae. The distributor is equipped with one or more sifters which are designed to segregate heavier particles from lighter particles and to thus prevent the heavier particles from entering the wrapping station of the cigarette rod making machine wherein a continuous rod-like tobacco filler is draped into a web of thin and readily penetrable wrapping material, normally a web of cigarette paper. Any longer and relatively hard particles which enter the rod-like filler are likely to puncture or tear the wrapper so that the corresponding cigarettes must be segregated from satisfactory cigarettes (namely from cigarettes with wrappers which are devoid of holes) for introduction into a cigarette ripping or breaking apparatus which is used to destroy the wrappers and to thus permit recovery of tobacco particles for reintroduction into the distributor.

The making of the filler in a cigarette rod making machine is preceded by conversion of tobacco particles into a relatively wide carpet which is thereupon sifted (normally by pneumatic means) to segregate heavier and harder particles from softer and lighter particles, and the softer and lighter particles are thereupon showered against an air-permeable conveyor which builds a continuous stream containing a surplus of tobacco particles. The stream is trimmed to remove the surplus, and the thus obtained trimmed stream constitutes a filler which is ready to be draped into a web of cigarette paper or the like. The resulting cigarette rod (wrapped filler) is severed in a cutoff to yield plain cigarettes of unit length or multiple unit length. The cigarettes are delivered to a packing machine, to storage or to a filter tipping machine.

Though the sifters (as mentioned above, such sifters normally include means for pneumatically segregating lighter particles from heavier particles) in presently known distributors or hoppers are quite efficient, it happens again and again that a certain percentage of satisfactory particles (particularly shreds) is entrained with the heavier particles and is discarded or processed with the heavier particles (fragments of stem and/or ribs) instead of being admitted into the rod forming zone. For example, certain lighter particles are so intimately entangled with adjacent heavier particles that they cannot be segregated from heavier particles during advancement across a so-called curtain of compressed air which is used to intercept and deflect lighter particles but is too weak to overcome the inertia of the heavier particles. Thus, the heavier particles traverse the curtain and are gathered in a suitable receptacle which is evacuated, either continuously or at intervals, to provide room for admission of additional heavier particles. The percentage of lighter particles which are entrained with the heavier particles is, or is likely to be, sufficiently high to warrant their recovery and readmission into the distributor or directly into the rod forming zone.

German Utility Model No. G 90 00 291.1 of Niepmann Traylift Transportsysteme GmbH & Co. KG (registered Mar. 1, 1990) discloses an apparatus which is designed to segregate lighter and shorter particles from heavier and longer particles in a tobacco stream wherein the two types of particles are in random distribution. The apparatus which is described in the Utility Model comprises several vibratory trays which are disposed one above the other. The uppermost tray is located beneath the outlet of a duct which delivers a mixture of longer and shorter tobacco particles, and the bottom wall of the uppermost tray is a grating which is to permit passage of certain particles but should retain the other (larger) particles. The second topmost tray has a bottom wall with relatively short longitudinally extending slots which permit certain particles to descend into the third tray having relatively small circular openings for the passage of certain particles onto the non-apertured and unslotted bottom wall of a fourth tray.

A drawback of the just described apparatus is that particles which happen to be caught in the interstices, slots and/or openings in the bottom walls of the upper trays clog the respective bottom walls after a short period of use. This necessitates frequent inspection and cleaning of the bottom walls. Moreover, once the interstices, slots or openings of a bottom wall are partially or completely clogged, the classifying action of the apparatus is immediately affected with the result that heavier and longer particles are separated with the shorter and lighter particles and/or vice versa.

OBJECTS OF THE INVENTION

An object of the invention is to provide an apparatus which can reliably classify streams of tobacco particles or other materials wherein longer and harder particles are in random distribution with softer and shorter particles.

Another object of the invention is to provide an apparatus which can be installed in the distributors or hoppers of cigarette rod making machines or in primary tobacco processing equipment to classify tobacco particles according to size, hardness and/or shape.

A further object of the invention is to provide an apparatus which can be used to classify once or twice classified particles of tobacco or the like to further reduce the likelihood of advancement of unsatisfactory particles into those regions of a machine where the unsatisfactory particles are likely to cause extensive damage and/or affect the quality of the products.

An additional object of the invention is to provide an apparatus which can be utilized to reduce the number of rejects in a cigarette rod making or filter tipping machine.

Still another object of the invention is to provide a novel and improved mechanical classifying apparatus which can be utilized with particular advantage for segregation of particles of tobacco stem and/or ribs from shredded tobacco leaf laminae in a cigarette rod making machine.

Another object of the invention is to provide an apparatus which requires less maintenance than heretofore known classifying apparatus.

A further object of the invention is to provide a novel and improved method of preventing clogging of the above outlined apparatus in actual use.

An additional object of the invention is to provide the apparatus with novel and improved means for gathering and transporting classified fractions of a tobacco stream to their destinations.

A further object of the invention is to provide a tobacco distributor or hopper which embodies or is combined with an apparatus of the above outlined character.

Still another object of the invention is to provide a cigarette rod making machine which embodies the above outlined apparatus.

SUMMARY OF THE INVENTION

The invention is embodied in an apparatus for classifying particles of fibrous material in a stream which contains a mixture of randomly distributed longer and shorter particles. The improved apparatus comprises a vibratory conveyor including at least one elongated vibratory trough having a stream receiving end, a discharge end for longer particles and a bottom with a plurality of depressions extending in a direction from the stream receiving end toward the discharge end. The depressions serve to align the particles of the stream which is delivered at the receiving end and the particles of which advance toward the dicharge end. The bottom has at least one slot which extends transversely of at least some of the depressions and transversely of the direction of advancement of particles toward the discharge end. The slot serves to permit entry and descent of at least some shorter particles.

In accordance with a presently preferred embodiment of the invention, the apparatus comprises means for delivering to the receiving end of the at least one trough a stream of longer and shorter tobacco particles. The longer particles normally constitute fragments of tobacco stem and/or ribs, and the shorter particles normally constitute shreds of tobacco leaf laminae.

The slot is preferably elongated, preferably extends across the entire bottom of the at least one trough, and preferably forms with the aforementioned direction an oblique angle, e.g., an angle which departs from a right angle by between about 5° and 50°.

The depressions are provided in the upper side of the bottom of the at least one trough, and such upper side preferably includes a smooth portion which is devoid of depressions or is provided with shallower depressions and is located immediately downstream of the at least one slot. Such bottom has first and second surfaces which flank the at least one slot; one of these surfaces is preferably smooth and is adjacent the smooth portion of the upper side of the bottom, i.e., the one surface is located downstream of the at least one slot.

The bottom of the at least one trough can be provided with a plurality of slots which may but need not be exactly parallel to each other and are spaced apart from each other in the aforementioned direction. The slots include a first slot and a last slot (as seen in the direction of advancement of the particles in the at least one trough), and the upper side of the bottom preferably includes a smooth section which is located downstream of the last slot and preferably extends all the way to the discharge end of the at least one trough.

The width of the at least one slot preferably increases in a direction from the upper side toward the underside of the bottom of the at least one trough. The arrangement is preferably such that the one surface of the bottom diverges from the other of the two surfaces which flank the at least one slot, namely in a direction from the upper side toward the underside of the bottom and in the direction of advancement of particles in the at least one trough.

The apparatus further comprises means for intercepting shorter particles which descend through the at least one slot of the bottom of the at least one trough. To this end, the conveyor preferably includes a second vibratory trough which constitutes the intercepting means. The second trough is located beneath the at least one trough and includes means for advancing intercepted shorter particles in a predetermined direction (e.g., in parallelism with the direction of advancement of particles in the at least one trough). Such apparatus preferably further comprises means for receiving and collecting and/or conveying shorter particles which enter the second trough through the slot or slots of the at least one trough.

The conveyor can further comprise a third vibratory trough which is preferably adjacent one side of the at least one trough. The one surface of the bottom of the at least one trough is located in the path of advancement of shorter particles which enter the at least one slot whereby the one surface intercepts at least some of the shorter particles which have entered or are about to enter the at least one slot. The latter has an end which is adjacent the third trough to deliver into the third trough those shorter particles which are intercepted by the one surface of the bottom. Delivery of intercepted shorter particles by the one surface into the third trough is facilitated due to the aforementioned oblique angle between the at least one slot and the direction of advancement of particles in the at least one trough. The arrangement is preferably such that the one surface slopes in the direction of advancement of particles in the at least one trough toward the end of the at least one slot; this promotes advancement of intercepted particles along the one surface and into the third trough.

The third trough can be at least substantially parallel to the at least one and/or second trough. The apparatus further comprises means for receiving longer particles from the discharge end of the at least one trough, and the arrangement may be such that the receiving means for longer particles also receives particles from the third trough, i.e., the third trough can be provided with means for delivering particles (which are received therein by sliding along the one surface of the bottom of the at least one trough) to the locus for reception of longer particles from the at least one trough.

The bottom of the at least one trough can include at least two sections, one at the upstream side and the other at the downstream side of the at least one slot. At least one of these upstream and downstream sections is preferably movable toward and away from the other section to thus alter the width of the at least one slot, e.g., for the purpose of selecting the length of those particles which should enter into and descend in the at least one slot into the aforementioned intercepting means, such as the second trough.

The improved apparatus can be installed in or adjacent a tobacco distributor (also called hopper), e.g., a tobacco distributor which forms part of or delivers tobacco particles to a cigarette rod making machine. The distributor includes a sifter which has an outlet serving to deliver a stream of randomly distributed shredded tobacco leaf laminae and fragmentized tobacco ribs and/or stem to the receiving end of the at least one trough. The means for intercepting shorter particles which descend through the at least one slot in the bottom of the at least one trough is then connected with means for conveying the intercepted shorter particles (i.e., mainly shredded tobacco leaf laminae) to the distributor for readmission into the sifter, i.e., for reintroduction into the path of movement of satisfactory tobacco particles toward the tobacco rod forming station of the cigarette rod making machine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
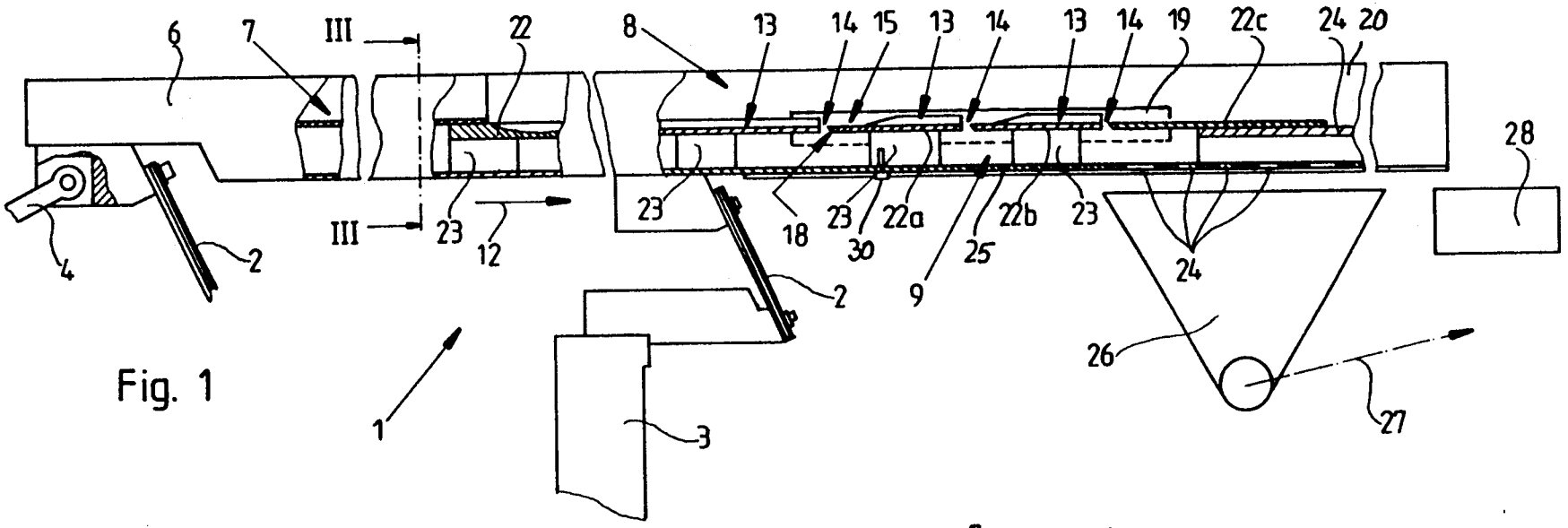
FIG. 1 is a fragmentary partly side elevational and partly longitudinal vertical sectional view of a classifying apparatus which embodies one form of the invention, the section being taken in the direction of arrows as seen from the line I—I in FIG. 2.

FIG. 1 shows a portion of an apparatus which embodies one form of the invention and is used to classify a continuous or interrupted stream of fibrous material wherein larger (particularly longer) particles (e.g., fragments of tobacco stem and/or ribs) are in random distribution with smaller (particularly shorter) particles (such as shredded tobacco leaf laminae). The apparatus comprises a vibratory conveyor 1 having three parallel troughs or trays including a first or upper elongated trough 8, a second or lower elongated trough 9, and a third (lateral) elongated trough 11. The means for imparting recurrent vibratory movements to the conveyor 1 (i.e., to the troughs 8, 9 and 11) includes packages of leaf springs 2 which connect the frame or housing 6 of the conveyor 1 to a frame 3, and one or more straps 4 which receive motion from eccentrics (not shown) in a manner well known from the art of vibratory conveyors for the transport of fibrous materials. The left-hand (receiving) end of the trough 8 receives successive increments of a stream of randomly intermixed longer and shorter tobacco particles from a delivering unit including a conveyor 7 which, in turn, receives successive increments of the stream from a sifter, such as the sifter 42 shown in FIG. 1 of commonly owned U.S. Pat. No. 4,185,644 granted Jan. 29, 1980 to Uwe Heitmann et al. The disclosure of this patent is incorporated herein by reference. The sifter 42 forms part of a distributor or hopper in a cigarette rod making machine and is intended to segregate all particles of ribs and/or stem from shredded tobacco leaf laminae. However, the segregated longer, heavier and bulkier particles (as mentioned above, such particles normally constitute fragments of tobacco stem and/or ribs) will entrain some of the shredded tobacco particles, and an object of the present invention is to further classify the once classified stream of tobacco particles in order to further reduce the likelihood of entrainment of useful short and soft particles with the less satisfactory or useless heavier, harder, bulkier and longer particles.

The bottom of the first trough 8 includes a series of successive sections 22, **22*a*, 22*b* and 22*c*. The major part (or at least a substantial part) of the upper side of each of the sections 22, 22*a*, 22*b* is channeled or grooved (as at 13) in that it comprises elongated depressions or valleys 17 alternating with hills or elevations 16 and extending in the direction (arrow 12) of advancement of tobacco particles from the receiving end (discharge end of the tobacco delivering conveyor 7) toward the discharge end (section 22*c* of the bottom of the trough 8) where the segregated longer particles enter a receiving means 28**, e.g., an elongated collecting bin or another suitable receptacle.

Figure 2:
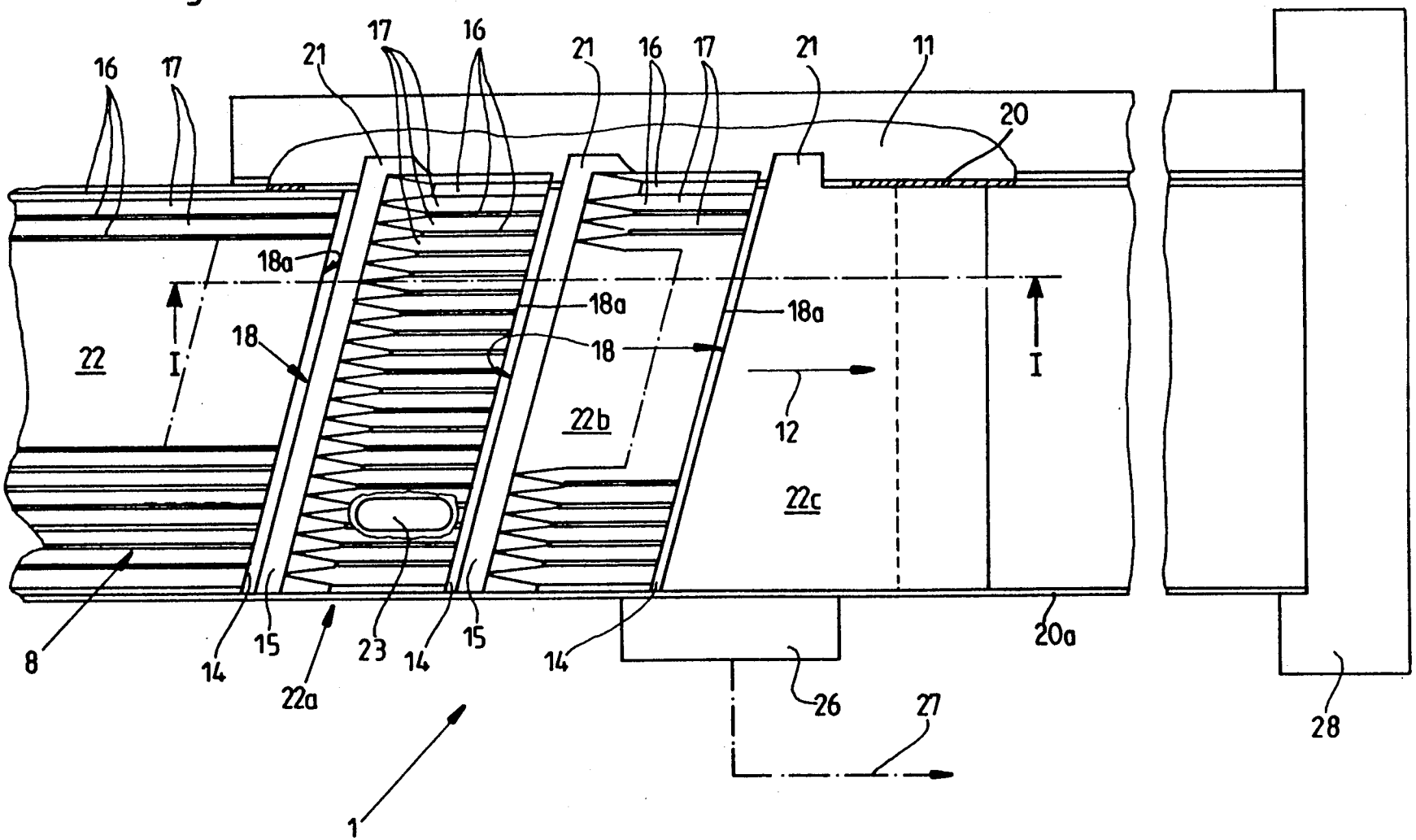
FIG. 2 is plan view of the apparatus which is shown in FIG. 1, with a portion of one sidewall of the top trough broken away.

The bottom of the trough 8 is further provided with at least one but preferably with two or more elongated slots 14 (FIG. 1 shows that the bottom including the sections 22 to **22*c* is provided with three slots 14 which are preferably but need not be parallel to each other—see FIG. 2) extending transversely of at least some of the depressions 17. Each of the illustrated slots 14 extends transversely of all of the depressions 17 in the bottom and each of these slots forms with the direction (arrow 12) of advancement of tobacco particles an oblique angle, i.e., an angle greater or smaller than a right angle. The slots 14 slope forwardly in the direction of arrow 12 from the lower sidewall 20*a* toward the upper sidewall 20 of the frame 6 (as viewed in FIG. 2), namely toward an opening 19 in the sidewall 20 forming part of the trough 8. The leftmost slot 14 of FIG. 1 extends between the sections 22 and 22*a*, the next or median slot 14 extends between the sections 22*a* and 22*b*, and the rightmost slot 14 extends between the sections 22*b* and 22*c* of the bottom of the trough 8. The sections 22*a*, 22*b* and 22*c* have lateral extensions 21 immediately downstream of the respective slots 14; such extensions project through the opening 19 and into the third or lateral trough 11 (the latter resembles a duct having a height approximating or matching the combined height of the troughs 8, 9 and serving to deliver the collected tobacco particles into the receptacle or bin 28**.

Each of the slots 14 is flanked or bounded by an upstream surface **18*a* and a downstream surface 18 which latter is smooth and diverges from the upstream surface 18*a* in a direction toward the underside of the respective section 22*a*, 22*b*, or 22*c* and in the direction which is indicated by the arrow 12. Thus, the width of each slot 14 increases in a direction from the upper side toward the underside of the bottom of the trough 8. The surfaces 18 have portions which extend along the respective extensions 21 and into the trough 11**.

The upper sides of the sections **22*a*, 22*b* include smooth portions or sections 15 which are located immediately downstream of the respective slots 14 and are adjacent the respective surfaces 18. The sections or portions 15 are not channeled or grooved and are located at the level of the deepmost portions of immediately following depressions 17 in the upper sides of the sections 22***a*, 22*b*. The upper side of the section 22*c* of the bottom of the trough 8 is smooth all the way from the adjacent slot 14 to the discharge end of the trough 8.

Figure 3:
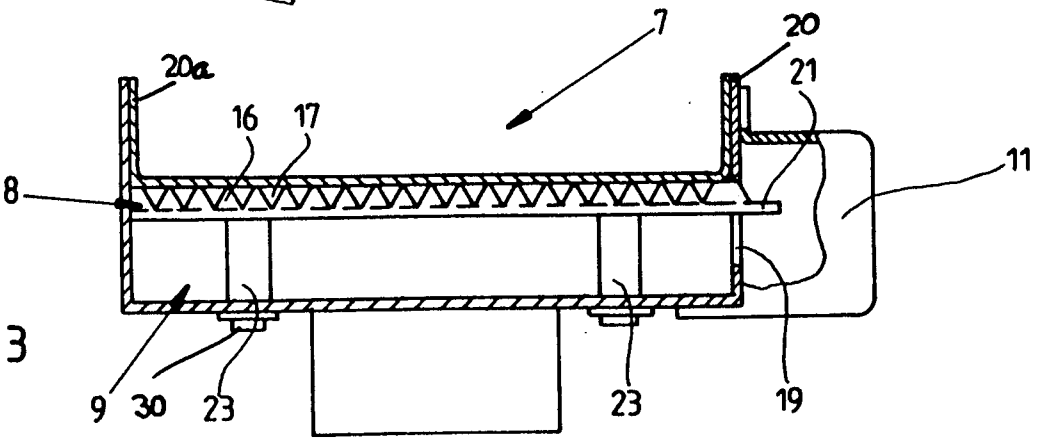
FIG. 3 is a transverse vertical sectional view substantially as seen in the direction of arrows from the line III—III in FIG. 1.

The sections 22, 22*a* and 22*b* have legs 23 which extend downwardly into and all the way to the bottom 25 of the second trough 9. The section 22 is fixedly mounted, i.e., it is not or need not be movable relative to the frame 6 and/or relative to the bottom 25 of the section 9. The sections 22*a*, 22*b* are movable in and counter to the direction of arrow 12 and can be fixed in selected positions. This enables the person or persons in charge to alter the width of the slots 14, e.g., to increase the width of one or two slots while reducing the width of the third slot or to reduce the width of two slots while increasing the width of the third slot. The section 22*c* is also movable in and counter to the direction of arrow 12 in order to increase the range of possible adjustments of the width of one or more slots 14. The legs 23 of the sections 22*a*, 22*b*, 22*c* can be releasably secured to the bottom 25 of the trough 9 by screws or bolts 30 (FIGS. 1 and 3) or other suitable fasteners which enable the person or persons in charge to alter the width of one, two or all slots 14. The legs 23 of the sections 22*a*, 22*b*, 22*c* are configurated and positioned in such a way that they do not appreciably interfere with advancement of tobacco particles along the bottom 25 of the second trough 9.

The bottom 25 of the second trough 9 is formed with openings 24 which are disposed above a funnel or hopper 26 serving to receive tobacco particles which have descended through the slots 14 and have advanced in the direction of arrow 12. The hopper 26 admits the thus collected particles into a conveyor 27 which serves to return such particles into the distributor of the cigarette rod making machine, e.g., into the magazine 1 or onto the conveyor 41 in the distributor which is shown in FIG. 1 of the patent to Heitmann et al., namely upstream of the sifter 42 so that the particles which leave the trough 9 can be delivered to the tobacco filler forming station of the machine. The conveyor 27 is or can constitute a pneumatic conveyor.

The operation is as follows:

The conveyor 7 delivers a continuous or discontinuous stream of once classified tobacco particles from the sifter in the distributor of the cigarette rod making machine, and such stream normally still contains some shredded tobacco leaf laminae in admixture to longer and harder particles which are likely to damage the wrapper (normally made of cigarette paper) of the wrapped rod-like filler which is ready to be subdivided into plain cigarettes of unit length or multiple unit length. Reference may be had to FIG. 5 of the patent to Heitmann et al. which shows the station wherein a web of cigarette paper is draped around a rod-like tobacco filler to form a tobacco rod which is thereupon severed at desired intervals by a cutoff to yield plain cigarettes of unit length or multiple unit length.

The housing 6 of the conveyor 1 is vibrated by the strap or straps 4 to thus cause the particles of the stream to advance in the direction of arrow 12. The longer particles (which normally constitute the majority of particles in the stream) enter into and are aligned or oriented in the direction of arrow 12 while advancing in the depressions 17 at the upper side of the first section 22 of the bottom of the trough 8. The thus oriented or aligned longer particles traverse the first slot 14 and reach the smooth section 15 of the upper side of the second section 22*a* of the bottom. However, at least some of the shorter and lighter particles (normally relatively soft shreds which constitute the desirable constituent in the tobacco filler of a cigarette) penetrate into the first slot 14 and descend therein to drop onto the bottom 25 of the second trough 9. Certain shorter particles which have entered the first slot 14 are caught at the smooth downstream surface 18 (i.e., by the section 22*a*) and begin to slide along the surface 18 toward and along the extension 21 of the section 22*a* to ultimately enter the third trough 11. The aforediscussed inclination of the slots 14 (in the direction of arrow 12 and toward the opening 19 in the sidewall 20 of the trough 8) greatly reduces the likelihood of clogging of the first slot 14 by shorter particles which were about to descend onto the bottom 25 of the trough 9 but were prevented from doing so by the smooth surface 18 of the section 22*a*. Since the particles which happen to be caught in the first slot 14 and are thereupon caused to enter the trough 11 are likely to include relatively hard particles of tobacco stem and/or ribs, such particles are not delivered onto the trough 9 but rather into the receptacle 28 which gathers the long and very long particles at the downstream end of the section 22*c*.

The same mode of operation is repeated at the second and third slots 14, i.e., acceptable shorter particles descend in the second and third slots 14 to be intercepted by the bottom 25 of the second trough 9, and some of the particles which have entered the second and/or third slot 14 slide along the respective downstream surface 18 and along the respective extension 21 to enter the third trough 11 via opening 19 in the sidewall 20.

It has been found that the provision of the slots 14 normally suffices to ensure reliable classification of the stream into particles which are not suitable for introduction into a rod-like tobacco filler (i.e., which are to be collected in the receptacle 28) and into particles which are satisfactory for processing into the filler of a cigarette rod and are to be returned to the distributor via trough 9, hopper 26 and conveyor 27.

The relatively long particles which accumulate in the receptacle 28 can be puffed and thereupon shredded or otherwise processed or utilized in a manner not forming part of the present invention. All that counts is to ensure that such longer particles should not come into contact with the web of wrapping material and that the relatively short and soft particles which have been entrained by the longer particles in the sifter of the distributor are gathered and returned into the distributor for introduction into the stream which is to be converted into a rod-like tobacco filler ahead of the wrapping station.

If the particles which enter and advance in the trough 11 are acceptable for use in the fillers of cigarettes, the discharge end of the trough 11 can be caused to deliver particles into the hopper 26 or directly into the magazine of the distributor.

It is within the purview of the invention to provide the bottom of the trough 8 with one or more slots which do not extend all the way across the space between the sidewalls 20 and 20*a* of the trough 8. However, it is presently preferred to provide the bottom of the trough 8 with sidewalls which do extend all the way across all of the depressions 17 and which preferably lead directly into the third trough 11.

The inclination of the slots 14 in the direction of arrow 12 and from the sidewall 20*a* toward the sidewall 20 will be selected with a view to ensure rapid expulsion of any particles which are caught at the downstream surfaces 18, i.e., which are likely to interfere with descent of shorter particles onto the bottom 25 of the second trough 9.

The second trough 9 constitutes an optional but desirable and advantageous feature of the improved apparatus. Thus, it would be possible to simply provide a hopper 26 beneath each slot 14 and to intermittently or continuously evacuate the contents of such discrete hoppers for readmission into the distributor upstream of the pneumatic sifter or even downstream of the sifter since the particles which have been capable of passing through the slots 14 are highly unlikely to damage the web of wrapping material. The utilization of a second trough is desirable and advantageous on the ground that such apparatus can be even more readily integrated into or combined with the distributor of an existing cigarette rod making machine or integrated into or combined with an existing primary tobacco processing equipment.

The third trough 11 also constitutes an optional but desirable and advantageous constituent of the improved apparatus. This trough automatically gathers all such particles which tended to but were incapable of actually passing through the slots 14 and might have a size and/or shape and/or hardness which could entail damage to the wrapper of a cigarette rod.

An important advantage of the improved apparatus is that the normally small percentage of useful particles can be reliably separated from the normally much higher percentage of long, heavy and hard particles by the simple expedient of channeling or grooving the upper side of the bottom **20–20*c* of the first trough 8 and by providing such bottom with one or more transversely extending slots 14**.

Another important advantage of the improved apparatus is that the smooth downstream surfaces 18 greatly reduce the likelihood of, or actually prevent, clogging of the slots 14. The likelihood of clogging of the slots 14 is further reduced due to the fact that the width of the slots 14 increases in a direction from the upper side toward the underside of the bottom **22–22*c* and that the slots 14 form oblique angles with the direction which is indicated by the arrow 12, i.e., that any particle which happens to be caught in a slot 14 immediately exhibits a tendency to slide toward and along the respective extension 21 and to enter the third trough 11 through the opening 19 in the sidewall 20. Such inclination of the slots 14** ensures that the apparatus requires a minimum of maintenance because the slots are not likely to be clogged in contrast to heretofore known apparatus such as that described and shown in the afore-discussed German Utility Model No. G 90 00 291 of Niepmann. Disturbance-free operation is particularly desirable in modern cigarette makers which are designed to turn out many thousands of cigarettes per minute.

A further important advantage of the apparatus is that it ensures, in a simple but effective manner, that the particles which are returned to the distributor via trough 9, hopper 26 and conveyor 27 are highly unlikely to contain relatively hard components which would be likely to tear, puncture and/or otherwise damage the wrapper of a cigarette rod. This results in a reduction of the number of rejects which are discovered when the individual cigarettes are tested for the condition of their wrappers.

Still another advantage of the improved apparatus is that it further increases the likelihood of introduction of all acceptable tobacco particles into the rod-like filler which is formed in a cigarette rod making machine. Thus, any acceptable particles which were not segregated from heavier, harder and longer particles in the normally pneumatically operated standard classifier or sifter in the distributor of a cigarette rod making machine are subjected to a preferably multi-stage mechanical sifting or classifying action downstream of the pneumatic sifter to ensure recovery of all or practically all particles which belong into the filler of the tobacco rod. This entails optimal utilisation of a very high percentage of acceptable tobacco particles and lower cost of the ultimate products.

An additional advantage of the improved apparatus is that the width of some or all of the slots 14 can be varied within a desired range. This renders it possible to conform the apparatus to the size of those particles which are to descend in and beyond the slots 14 and to be collected in the trough 9 and delivered into the hopper 26 for reintroduction into the distributor upstream of the pneumatic sifter. Adjustability of the width of the slots 14 by the simple expedient of dividing the bottom of the trough 8 into two or more sections and of adjustably mounting one or more sections in the frame or housing 6 of the conveyor 1 renders it possible to eliminate the need for spare troughs and/or other modules of the apparatus.

Another advantage of the improved apparatus is its simplicity and compactness. The apparatus can be readily installed in or combined with the distributor of an existing rod making machine or can be utilized as part of the preliminary tobacco processing equipment. The amount of maintenance work is negligible, and such maintenance work (normally involving infrequent cleaning of the slots 14) is simple and can be carried out without the need for even partial dismantling of the apparatus or of the machine in which the apparatus is put to use.

The invention was described with reference to the classification of a tobacco stream which contains fragments of tobacco stem and/or ribs in admixture with shreds of tobacco leaf laminae. However, the improved apparatus can be used with equal or similar advantage as a means for classifying the constituents of streams which contain other types of randomly distributed particles. For example, the improved apparatus can be utilized in primary processing of tobacco which precedes the shredding of tobacco leaves. The apparatus can be used to segregate shorter and lighter fragments of ribs and/or stem from longer and heavier fragments of ribs and/or stem or under any analogous circumstances when it is desirable or necessary to segregate heavier, larger, bulkier and particularly longer particles from lighter, smaller and particularly shorter particles which are randomly intermixed with the longer particles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for classifying particles of fibrous material in a stream which contains a mixture of randomly distributed longer and shorter particles, comprising a vibratory conveyor including at least one elongated vibratory trough having a stream receiving end, a discharge end for longer particles and a bottom with a plurality of depressions extending in a direction from said receiving end toward said discharge end and arranged to receive and align the particles of the stream which is delivered at said receiving end and the particles of which advance toward said discharge end, said bottom having at least one slot extending transversely of at least two of said depressions and of said direction to permit entry and descent of at least some shorter particles.

2. The apparatus of claim 1, wherein said bottom has a plurality of slots which are spaced apart from each other in said direction and include a first and a last slot, said bottom further having an upper side which is provided with said depressions and includes a smooth section which is located downstream of said last slot.

3. The apparatus of claim 1, wherein said bottom has an upper side and an underside and the width of said at least one slot increases in a direction from the upper side toward the underside of said bottom.

4. The apparatus of claim 3, wherein said bottom has two surfaces flanking said at least one slot, one of said surfaces being located downstream of said at least one slot and diverging from the other of said surfaces in a direction from the upper side toward the underside of said bottom.

5. The apparatus of claim 1, further comprising means for intercepting shorter particles which descend through said at least one slot.

6. The apparatus of claim 5, wherein said conveyor further includes a second vibratory trough which constitutes said intercepting means, said second trough having means for advancing intercepted shorter particles in a predetermined direction and further comprising means for receiving shorter particles from said second trough.

7. The apparatus of claim 10, wherein said conveyor further comprises a third vibratory trough which is adjacent one side of said at least one trough, said bottom having two surfaces which flank said at least one slot and one of which is located downstream of said at least one slot in the path of shorter particles which enter said at least one slot whereby said one surface intercepts some of the shorter particles which enter said at least one slot, said at least one slot having an end adjacent said third trough to deliver into the third trough those shorter particles which are intercepted by said one surface.

8. The apparatus of claim 7, wherein said at least one slot forms with said direction an oblique angle and said one surface slopes in said direction toward said end of said at least one slot to promote the advancement of intercepted shorter particles along said one surface and into said third trough.

9. The apparatus of claim 8, further comprising means for receiving longer particles from the discharge end of said at least one trough.

10. The apparatus of claim 9, wherein said third trough is substantially parallel to said at least one trough.

11. The apparatus of claim 9, wherein said third trough comprises means for delivering particles to said means for receiving longer particles from said at least one trough.

12. Apparatus for classifying particles of fibrous material in a stream which contains a mixture of randomly distributed longer and shorter particles, comprising a vibratory conveyor including at least one elongated vibratory trough having a stream receiving end, a discharge end for longer particles and a bottom with a plurality of depressions extending in a direction from said receiving end toward said discharge end and arranged to receive and align the particles of the stream which is delivered at said receiving end and the particles of which advance toward said discharge end, said bottom having at least on slot extending transversely of at least two of said depressions and of said direction to permit entry and descent of at least some shorter particles, said bottom having an upper side which is provided with said depressions and said upper side including a smooth portion which is located immediately downstream of said at least one slot and is devoid of depressions.

13. The apparatus of claim 12, wherein said bottom has first and a second surfaces which flank said at least one slot, one of said surfaces being smooth and being adjacent said smooth portion of said upper side.

14. Apparatus for classifying particles of fibrous material in a stream which contains a mixture of randomly distributed longer and shorter particles, comprising a vibratory conveyor including at least one elongated vibratory trough having a stream receiving end, a discharge end for longer particles and a bottom with a plurality of depressions extending in a direction from said receiving end toward said discharge end and arranged to receive and align the particles of the stream which is delivered at said receiving end and the particles of which advance toward said discharge end, said bottom having at least one slot extending transversely of at least two of said depressions and of said direction to permit entry and descent of at least some shorter particles; a tobacco distributor including a sifter having an outlet which delivers the stream at said receiving end; means for intercepting the shorter particles which descend through said at least one slot; and means for conveying the intercepted shorter particles to said distributor.

15. The apparatus of claim 14, wherein said distributor forms part of a cigarette making machine and the longer particles of the stream include portions of tobacco stem and ribs.

16. Apparatus for classifying particles of fibrous material in a stream which contains a mixture of randomly distributed longer and shorter particles, comprising a vibratory conveyor including at least one elongated vibratory trough having a stream receiving end, a discharge end for longer particles and a bottom with a plurality of depressions extending in a direction from said receiving end toward said discharge end and arranged to receive and align the particles of the stream which is delivered at said receiving end and the particles of which advance toward said discharge end, said bottom having at least one slot extending transversely of at least two of said depressions and of said direction to permit entry and descent of at least some shorter particles; and means for delivering to said receiving end a stream of longer and shorter tobacco particles.

17. Apparatus for classifying particles of fibrous material in a stream which contains a mixture of randomly distributed longer and shorter particles, comprising a vibratory conveyor including at least one elongated vibratory trough having a stream receiving end, a discharge end for longer particles and a bottom with a plurality of depressions extending in a direction from said receiving end toward said discharge end and arranged to receive and align the particles of the stream which is delivered at said receiving end and the particles of which advance toward said discharge end, said bottom having at least one elongated slot to permit entry and descent of at least some shorter particles, said slot extending transversely of a plurality of said depressions and forming with said direction an acute angle.

18. Apparatus for classifying particles of fibrous material in a stream which contains a mixture of randomly distributed longer and shorter particles, comprising a vibratory conveyor including at least one elongated vibratory trough having a stream receiving end, a discharge end for longer particles and a bottom with a plurality of depressions extending in a direction from said receiving end toward said discharge end and arranged to receive and align the particles of the stream which is delivered at said receiving end and the particles of which advance toward said discharge end, said bottom having at least one slot extending transversely of at least two of said depressions and of said direction to permit entry and descent of at least some shorter particles, said bottom having at least two sections and said at least one slot being located between said at least two sections, at least one of said at least two sections being movable toward and away from the other of said at least two sections to thereby vary the width of said at least one slot.

* * * * *